US008109845B2

(12) United States Patent
Duty

(10) Patent No.: US 8,109,845 B2
(45) Date of Patent: Feb. 7, 2012

(54) SPORTS TARGET DEVICE AND METHOD

(76) Inventor: Christian P. Duty, Asheboro, NC (US)

( * ) Notice: Subject to any disclaimer, the term of this patent is extended or adjusted under 35 U.S.C. 154(b) by 29 days.

(21) Appl. No.: 12/576,462

(22) Filed: Oct. 9, 2009

(65) Prior Publication Data

US 2011/0086733 A1 Apr. 14, 2011

(51) Int. Cl.
*A63B 69/00* (2006.01)
*F41J 5/056* (2006.01)

(52) U.S. Cl. ..... 473/446; 473/478; 273/381; 273/400

(58) Field of Classification Search ..... 273/398–402, 273/381; 473/446, 476–478, 154, 192, 197, 473/455, 456
See application file for complete search history.

(56) References Cited

U.S. PATENT DOCUMENTS

| | | | | |
|---|---|---|---|---|
| 3,197,208 | A * | 7/1965 | Makar | 473/190 |
| 4,607,842 | A * | 8/1986 | Daoust | 473/446 |
| 4,842,283 | A * | 6/1989 | LeBel et al. | 273/392 |
| 5,306,013 | A * | 4/1994 | Germinario | 473/182 |
| 5,634,640 | A | 6/1997 | McCarrel | 473/446 |
| 5,725,444 | A * | 3/1998 | Heden | 473/446 |
| 5,993,334 | A * | 11/1999 | McNamara | 473/446 |
| 6,142,892 | A * | 11/2000 | Dennis | 473/494 |
| 6,402,641 | B1 | 6/2002 | Lee | 473/446 |
| 6,551,205 | B1 | 4/2003 | Koelzer, Jr. et al. | 473/454 |
| 6,554,284 | B2 * | 4/2003 | Chou | 273/371 |
| 6,692,384 | B2 * | 2/2004 | Bains | 473/446 |
| 7,134,976 | B1 | 11/2006 | Smith | 473/446 |
| 7,252,604 | B2 * | 8/2007 | Birss | 473/446 |
| 7,258,344 | B2 | 8/2007 | Giegerich et al. | 273/371 |
| 7,407,452 | B1 * | 8/2008 | Gawthrop | 473/446 |
| 7,614,968 | B1 * | 11/2009 | Davies | 473/466 |
| 2002/0042312 | A1 * | 4/2002 | Decloux | 473/476 |
| 2003/0030218 | A1 * | 2/2003 | Zucchi et al. | 273/371 |
| 2007/0176368 | A1 * | 8/2007 | Lamberti et al. | 273/371 |
| 2007/0184920 | A1 * | 8/2007 | Mah et al. | 473/446 |

OTHER PUBLICATIONS

An eight (8) page instruction manual from Fisher-Price ® for "Super Sounds Soccer™" copyright 2003 Mattel, Inc.

* cited by examiner

*Primary Examiner* — Mark Graham

(57) ABSTRACT

An interactive sports target device is designed specifically to be suspended on the inside of a net attached to a goal. The target device emits an audible signal when impacted by a projectile such as a ball, puck or the like. The target device is light in weight to avoid deforming the net and can be easily attached or detached to the net in less than 30 seconds. The target device is reversible and can include both a front and rear with contrasting colors or designs. Both mechanical and electronic target devices are shown which provide a loud audible sound when struck by a projectile. Advanced electronic versions contain a programmable processor.

13 Claims, 5 Drawing Sheets

SPORTS TARGET DEVICE AND METHOD

FIELD OF THE INVENTION

The invention herein pertains to sport target devices and particularly pertains to a lightweight sport target device which is affixed to the net of a goal and emits an audible sound when impacted by a projectile such as a soccer ball, hockey puck or other sports projectile.

DESCRIPTION OF THE PRIOR ART AND OBJECTIVES OF THE INVENTION

In sports such as hockey or soccer where scoring and winning depend upon successfully directing a projectile past a goalkeeper and into a goal, the ability of the players to accurately direct the projectile into areas of the goal which are difficult to guard by the goalkeeper is of primary importance. Developing this ability (accuracy) in players is also of primary importance. There are many drills and exercises designed by coaches and trainers to improve a player's ability to accurately strike a soccer ball, but there is little specialized training equipment to supplement standard drills and exercises causing players to resort to various ad-hoc target devices such as brightly colored t-shirts hanging in the corners of soccer nets, or cones placed on the ground.

Though many target devices for soccer or hockey have been used in the past, none seem to have achieved widespread use or popularity. A majority of conventional target devices designed for use with a goal attach to the front of the goal frame and often preclude the use of a goalkeeper during the drill. Since the area defined by the goal frame (also known as the goal plane) is considered in the field of play, the goalkeeper must be able to move through the goal area and any target device which extends therein is a danger to the goalkeeper. Such devices could be used as targets in drills, but would have to be dismantled before a scrimmage game or the introduction of a goalkeeper.

Conventional target devices suffer a few common flaws such as bulkiness, heaviness and difficulty in installation and use as well as potential danger to the players by using hard metals, cords or ropes.

U.S. Pat. No. 7,134,976 includes a rigid target support which intrudes into the goal plane of the soccer goal and into the field of play. U.S. Pat. No. 6,554,284 is an impact sensor but is not designed to be easily attachable to a net and has no audible signal. U.S. Pat. No. 6,402,641 is designed to extend through the goal plane and U.S. Pat. No. 5,634,640 suffers the same disadvantage. U.S. Pat. No. 6,551,205 is an electronic target system with the potential for audible feedback, but is it not designed to be easily attachable to a sports goal net. U.S. Pat. No. 7,258,344 provides an electronically scored game with audible feedback for darts, football, table hockey and other games.

Thus in view of the problems and disadvantages of prior sports target devices, the present invention was conceived and one of its objectives is to provide a sports target device in combination with a sports net which is easily installable, versatile and highly effective in the training of athletes.

It is another objective of the present invention to provide a sports target device which can be used for individual training and by teams for training and scrimmage games.

It is still another objective of the present invention to provide a sports target device which is lightweight, highly portable, adjustable and safe.

It is yet another objective of the present invention to provide a sports target device having audible feedback.

It is still a further objective of the present invention to provide an embodiment of a sports target device having programmable modes.

It is yet a further objective of the present invention to provide a sports target device and method of use providing either mechanically or electrically produced audible sounds for training athletes.

Various other objectives and advantages of the present invention will become apparent to those skilled in the art as a more detailed description is set forth below.

SUMMARY OF THE INVENTION

The aforesaid and other objectives are realized by providing a sport target device which in one embodiment has a disk shape, approximately 18" (45.7 cm) in diameter and approximately 3" (7.6 cm) wide, weighing approximately 1 lb. (0.453 Kg) and is electronically operated. An alternate rectangular embodiment measures approximately 3' (0.914 m) long, 18" (45.7 cm) wide, and 3" (7.6 cm) deep weighing approximately 2 lb. (0.90 Kg). As understood, the target device could be made larger or smaller depending on its specific construction and components used and is mechanically operated.

The target device can have either a semi-rigid housing in the preferred form, or a soft shell (flexible) housing. In the soft shell target device, the housing is made of a synthetic, water-resistant flexible fabric such as canvas. The hard or semi-rigid shell or housing is made of a synthetic, water-resistant molded polymer. Hooks and/or straps, tapes, cords or other means of attachment to a sports goal or practice net extend from the exterior of the housing in both the preferred and alternate embodiments of the target device.

A mechanical or electronic means of detecting the impact of a projectile and audibly alerting nearby personnel upon impact is provided. The mechanical version consists of one or more bells having a clapper or the like which are activated upon impact by the projectile. The preferred electronic version consists of an impact sensor such as a peizo or vibration switch and a sound source such as a buzzer or a speaker. If a speaker is used, a microchip with a digital audio file and battery pack power source are connected thereto.

More advanced electronic embodiments utilize a central processing unit (CPU) to program and activate training features such as a timer and a counter. A rechargeable battery pack with a means for recharging without removal are utilized. Both the front and rear of the target device housing can have either the same or different colors or designs. The target device can be formed to detect the impact of a projectile on one or both sides. As a further alternative RF capability for remote programming and the transmission and reception of data between target devices allows for synchronization of multiple target devices.

In the preferred embodiment, the sports target device functions as an interactive game and training device and is attached to the inside rear or sides of a sports goal or practice net and hangs thereagainst. The target device so positioned does not create a hazard to the players and can be easily removed and installed at another position on the goal net as desired. Because the audible feedback is a more reliable and more satisfying way of detecting projectile impact than visual eyewitnesses, the target device is better for both trainers and players for a variety of training and game applications.

Beginning soccer players have a tendency to direct the ball/projectile toward the center of the goal. Even when a goalkeeper is standing in the center, players will often direct the projectile directly at the goalkeeper, though the player should direct the projectile toward the corners in an attempt to score a goal. The explanation for such direction is that the eyes and brain automatically focus on the goalkeeper, and the body reacts to that focus. It is difficult for a player to focus on hitting the right spot, because the right spot is an almost invisible goal net.

However, if players practice their focus regularly with the interactive target device located for example in the rear corners of the goal net, then their bodies and minds become conditioned to focus and aim for that point even when the target device is removed. The goalkeeper in guarding the goal moves through the area defined by the front frame of the goal and since the target device is placed inside the goal on and against the rear or sides of a goal net, it is away from the field of play and safe for the goalkeeper and other players. With the target devices in position players progress quickly in their training as focus to hit the target is heightened in order to avoid the goalkeeper and score a goal. With the present sports target device providing audible feedback upon each impact, players take turns practicing using the instep to shoot the ball accurately toward the corner of the goal without the goalkeeper in position. Once players have a chance to practice the skill with only the target devices the goalkeeper is then introduced to gradually increase the intensity of the training.

Other features such as a means for recording the number of impacts, a means for presetting a desired number of impacts, a means of alerting the player(s) when the preset number of impacts has been reached, a means of setting a time limit for certain games and training applications, a means of receiving and transmitting data between target devices, and a means of recharging the battery pack without removing the battery pack are discussed in more detail below.

DETAILED DESCRIPTION OF THE PREFERRED EMBODIMENT AND OPERATION OF THE INVENTION

Figure 1:
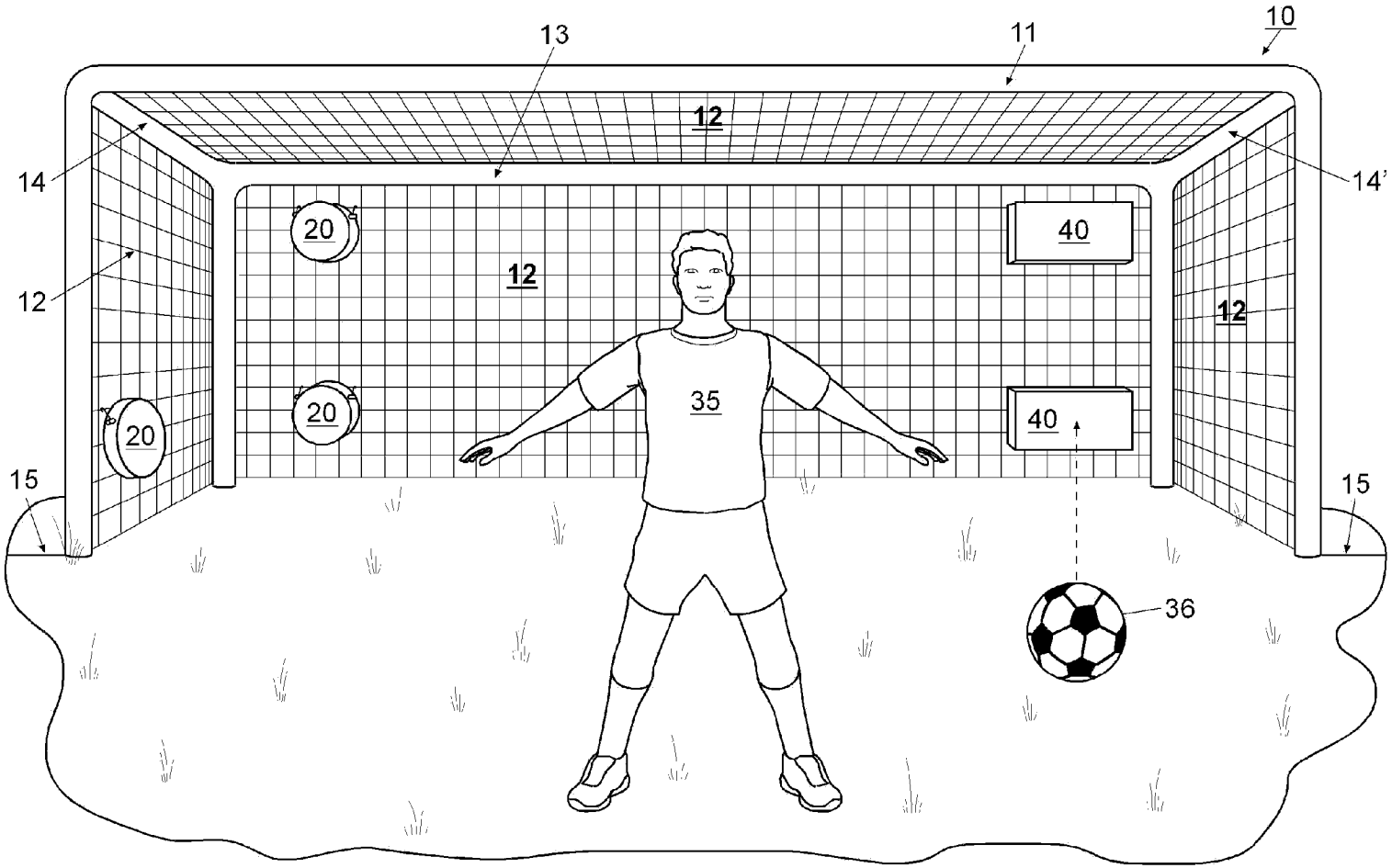
FIG. 1 illustrates a schematic representation of a soccer goal and goalkeeper with numerous sports target devices affixed to the net of the goal.

For a better understanding of the invention and its operation, turning now to the drawings, FIG. 1 shows a schematic representation of conventional soccer goal 10 as may be used by amateur or professional athletes. Goal 10 includes front vertical inverted U-shaped frame member 11 and rear vertical inverted U-shaped frame member 13 each having net 12 attached thereto. Front frame member 11 and rear frame member 13 are joined together by frame support members 14, 14' which are made of rigid tubing. Net 12 is generally formed of nylon or other suitable polymeric materials and may be continuous and held in place on goal 10 by various standard fasteners to front frame member 11, rear frame member 13 and support members 14, 14' as shown in FIG. 1.

As would be understood and seen in FIG. 1, line 15 designates the field of play whereby front U-shaped frame member 11 is within the field of play whereas rear frame member 13 is not. Soccer goal 10 is conventional and is equipped with target devices 20 which are circular and target devices 40 which are rectangular for practice and scrimmage purposes. While several target devices are seen, only one or more may be used as desired. Ice hockey and other sports often utilize goals which are somewhat similarly shaped to soccer goal 10 although the size and dimensions may greatly vary depending on the particular league or player classification in which they are employed. Such other sport goals could similarly utilize target devices 20, 40.

Figure 6:
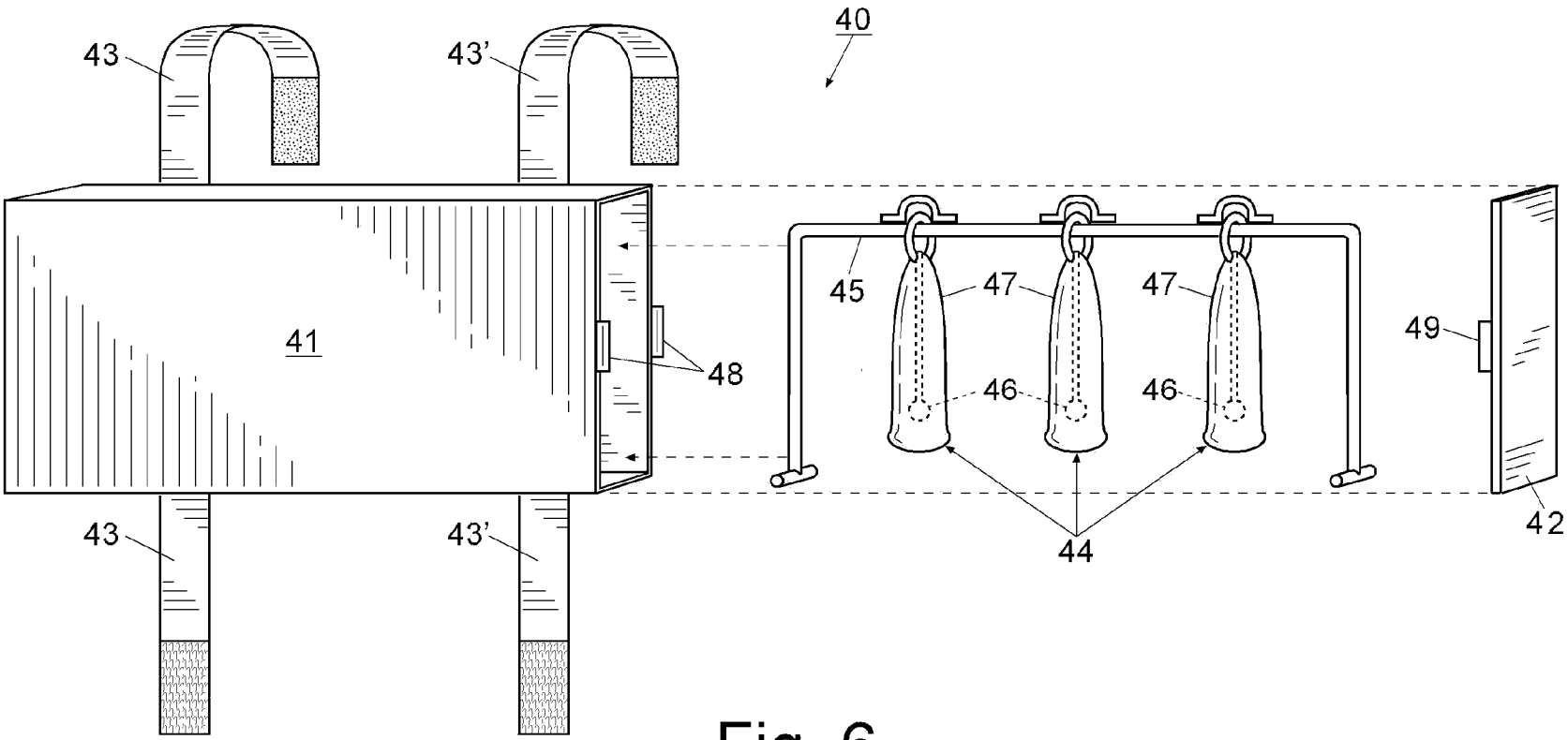
FIG. 6 demonstrates an alternate mechanical embodiment of the sports target device.

Target devices 20, 40 as selected are placed directly on the inside of net 12 at various positions beyond front frame member 11 as seen for example in FIG. 1. Circular target devices 20 are affixed to net 12 by a series of 360° swivel hooks 51 (FIG. 2) whereas rectangular target devices 40 are held on net 12 by hook and loop fastener type straps (FIG. 6). Alternate standard means for attaching target devices 20, 40 can also be used. The exact placement of target devices 20, 40 are selected for focal points of the players' attention when attempting to score goals. The exact number and placement and type of target devices may be chosen and modified as desired by the players or coaching staff. The purpose of target devices 20, 40 is to provide an impact sensitive target that provides an audible sound when hit which allows players to attempt a goal during practice, training or a scrimmage game by hitting a particular target device 20 or 40 with a projectile (ball, hockey puck or the like) to enable the player to better focus and position his kick during actual game conditions. As the projectile directed towards goal 10 moves at a very rapid speed, when the projectile strikes a target device such as target device 20 or 40 an audible signal is produced to notify personnel that the particular target device has been impacted. Soccer goalkeeper 35 as seen in FIG. 1 has the best chance of stopping soccer ball 36 if ball 36 is driven to the central portion of goal 10. By thus training the players to focus and drive ball 36 to either the upper or lower, left or right, rear or sides of goal 10 where target devices 20, 40 are placed, a better chance of scoring will be realized.

Figure 2:
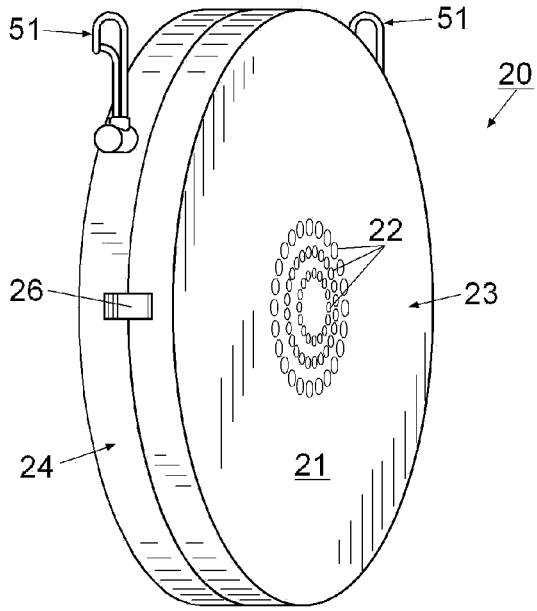
FIG. 2 depicts the preferred sports target device as removed from the net of the goal as seen in FIG. 1.
Figure 3:
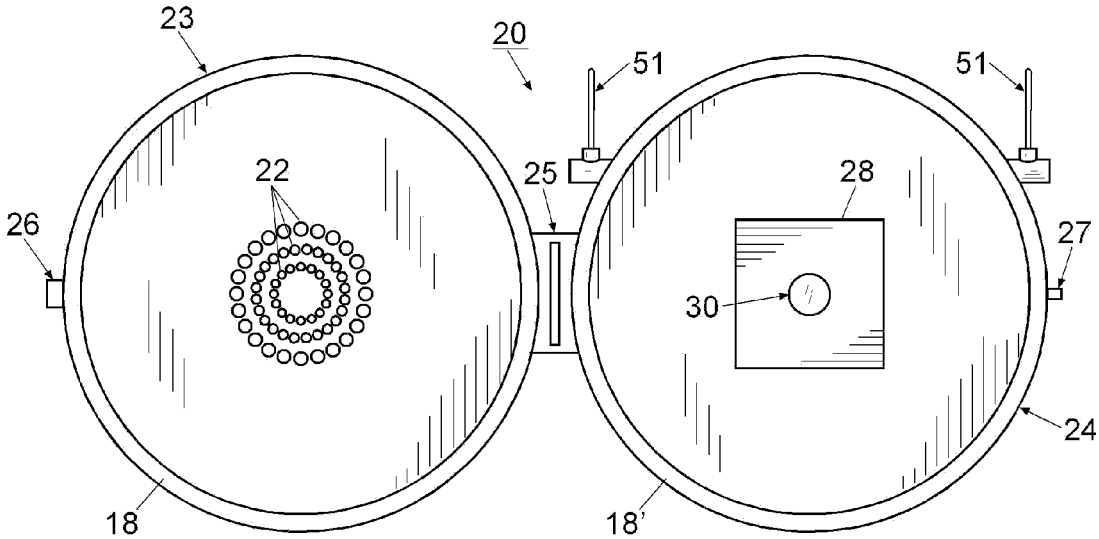
FIG. 3 pictures the sports target device as seen in FIG. 2 in an open posture to show the inner components.

FIG. 2 shows a perspective view of target device 20 comprising a semi-rigid, flexible polymeric housing 21 with front 23 and rear 24 which are pivotably joined by hinge 25 as seen in FIG. 3. Front 23 and rear 24 each include offset lip edges 18, 18' (FIG. 3) for secure sealing when housing 21 is closed. Front 23 may have a red color, whereas rear 24 may be colored blue and the target device 20 may be hung or suspended on net 12 with either front 23 or rear 24 exposed to the players. As seen in FIG. 3, front 23 includes usual catch 26 which engages usual latch 27 of rear 24 when housing 21 is closed as shown in FIG. 2. Openings 22 in front 23 allow sound emitted by electronic audible alarm 28 which is secured to the inside wall of rear 24 to pass therethrough. Contained within audible alarm 28 is electrical circuitry 29 shown schematically in FIG. 4. As seen, spring loaded switch 30 allows electricity to flow through electrical circuitry 29 when struck for example by a sports projectile such as soccer ball 36. Switch 30 may be of the conventional peizo type. Once switch 30 closes, power from battery 31 is provided to sound producing speaker 32 when off/on switch 33 is closed to allow an audible sound from speaker 32 of sufficient volume to notify nearby personnel that target device 20 has been struck. Switch 30 is depressed to activate circuitry 29 as flexible front 23 or rear 24 of housing 21 is deformed inwardly when struck by soccer ball 36.

Figure 4:
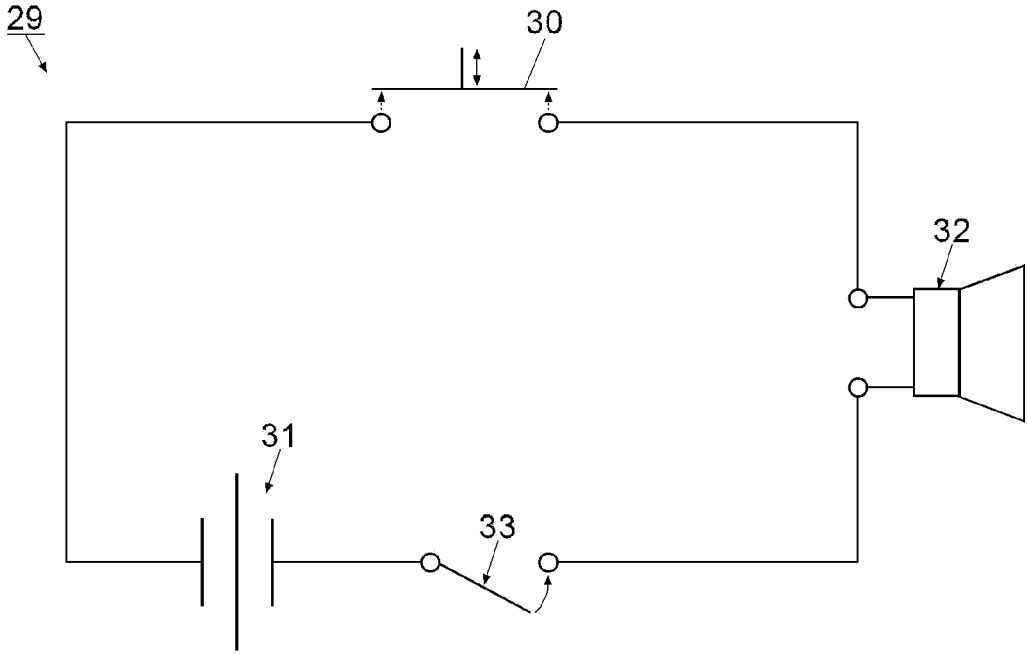
FIG. 4 schematically represents the electrical circuitry of the sports target device as seen in FIG. 3.
Figure 5:
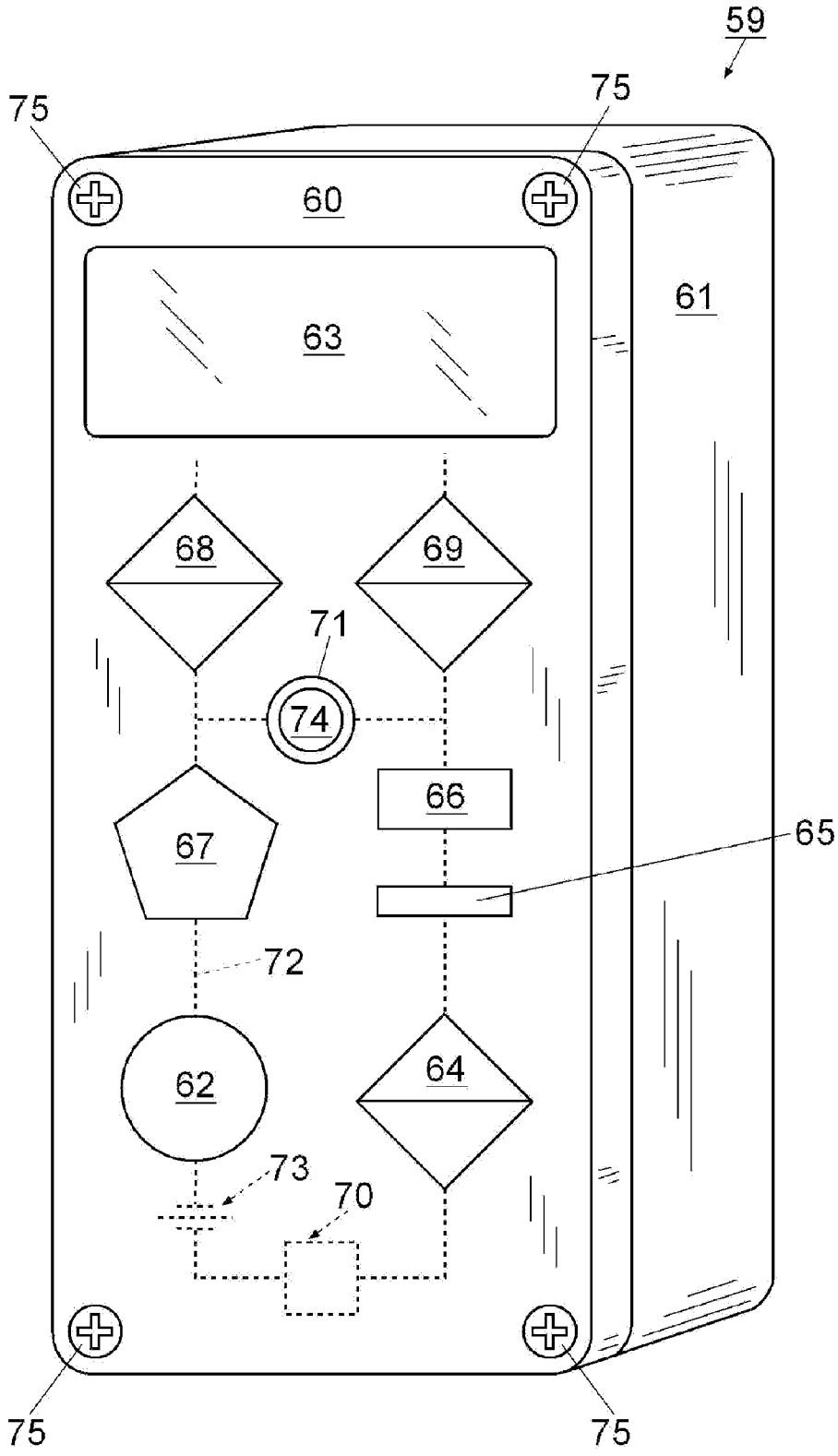
FIG. 5 demonstrates in schematic representation the CPU of an alternate electronic embodiment of the sports target device.

In an alternate electronic embodiment of the target device (not shown), flexible housing 21 includes central processing unit or CPU 59 as shown in FIG. 5 which is powered by low voltage rechargeable battery pack 73. CPU 59 is substituted for circuitry 29 as seen in FIG. 4 and contains programmable processor 70 connected to electrical circuitry 72 which allows the user to set the mode of operation for the target device including but not limited to the following modes: 1) Audible Count (default), 2) Sound Effect, 3) Impact Limit, 4) Timer and 5) Impact Limit/Timer.

In this embodiment, CPU 59 includes faceplate 60 with on/off button 62 which stops or terminates electricity from the low voltage rechargeable battery pack 73 to internal electrical circuitry 72 contained therein. Faceplate 60 includes LCD screen 63, volume control 64, reset button 65, set button 66, sound effect selector button 67, timer set button 68 and impact limit set button 69 all connected to electrical circuitry 72. Screws 75 maintain faceplate 60 to bottom 61. Sensor switch 71 has a depressable button 74 which is in position against the inside surface of front 23. Front 23 deforms when struck by a projectile and applies pressure to button 74 which in turn activates sensor switch 71 to cause an audible sound.

In the method of use of CPU 59 once the power is turned on in this embodiment using on/off button 62, the target device is ready to use in the "audible count" mode or default mode whereby a recorded human or simulated voice audibly counts each detected impact up to one hundred (100) impacts before automatically resetting. LCD screen 63 simultaneously visually displays the number of recorded impacts.

The next available mode for CPU 59 is the "sound effect" mode which is engaged by depressing sound effect select button 67. Depressing sound effect select button 67 one or more times will allow the user to cycle through the available sound effects. Each time sound effect select button 67 is depressed the name of the sound effect is visually displayed on LCD screen 63 and by depressing and holding sound effect select button 67 a low decibel version of the particular sound effect displayed on LCD screen 63 will be audibly emitted. Once a desired sound effect is selected the user ceases depressing sound effect select button 67 whereby the target device is ready to use in sound effect mode. Upon each detected impact by a projectile the target device will audibly emit the selected sound effect. While in this mode LCD screen 63 simultaneously visually displays the number of recorded impacts. The default audible count mode can be engaged while the target device is in sound effect mode by simply cycling through the available sound effects until it cycles back to the audible count mode.

The next available mode for CPU 59 is the "impact limit" mode in which the user programs a desired number of impacts using impact limit set button 69 and then depresses set button 66 to engage the target device. The impact limit mode can be entered while the target device is in audible count mode or sound effect mode. For example, if the user selects ten (10) as the desired number of impacts, the target device will emit either an audible count or the selected sound effect until the tenth impact, when the target device will emit both the chosen audible signal and immediately following will emit a unique audible signal to communicate to the user that the desired number of impacts has been reached.

The next available mode for CPU 59 is the "time limit" mode in which the user programs a desired time limit for the session. The time limit mode can be entered from either the audible count mode or the sound effect mode by depressing timer set button 68 and then set button 66. The time countdown is on a slight delay to give the user or programmer time to move away from the target device, and will begin five (5) seconds after set button 66 is depressed. Depressing reset button 65 anytime while in this mode will reset the timer to the last programmed time, and after the five (5) second delay, the countdown will begin again. During the time countdown, the target device will emit the chosen audible signal upon impact as well as recording and visually displaying on LCD screen 63 the number of impacts during the timed session. When time has expired, a special audible "time is up" signal will be emitted, and the user can open housing 21 to access the visual display to see how many times the target device was impacted during the time limit.

The next available mode for CPU 59 is the "impact limit/timer" mode, in which an impact limit game is played with a time limit. The impact limit/timer mode is entered by depressing either impact limit set button 69 first, until the desired number of impacts is chosen, and then depressing timer set button 68 until the desired time limit is reached, or vice versa. After setting both limits, set button 66 is depressed, and after a five (5) second delay, the game begins. If the desired number of impacts is reached within the time limit, a special audible "win" signal will be emitted. If the desired number of impacts has not been reached when the time limit expires, a special audible "lose" signal will emit from the device. If reset button 65 is depressed while in this mode, it will reset the target device to the last programmed impact limit/timer game, and begin again after the five (5) second delay. Volume control 64 is utilized for controlling the volume of the audible signals selected in any mode.

Other features could also be included such as a means for recording the number of impacts, for presetting a desired number of impacts, for alerting the user(s) when the preset number of impacts has been reached, for setting a time limit for certain games and applications, for receiving and transmitting data between devices, and for recharging the battery without removing the battery.

An alternate mechanical embodiment of the invention is seen by target device 40 in FIGS. 1 and 6. Target device 40 is formed from a conventional, flexible durable canvas fabric to provide housing 41 with closure 42 seen exploded therefrom. Standard opposing hook and loop strips 48, 49 secure closure 42 to housing 41. Housing 41 is affixed to net 12 as shown in FIG. 1 by hook and loop fastener straps 43, 43' which are joined at their ends after passing through net 12. Housing 41 may also have for example a red colored front and blue colored rear for reversible purposes as described above regarding housing 21 as shown in FIG. 3. Straps 43, 43' are used for simplicity and efficiency in mounting and dismounting target device 40. Within housing 41 is an array of metal bells 44 which are affixed to a wire frame 45 as shown in FIG. 6. Bells 44 are pivotably affixed at the top to wire frame 45 to allow them to easily ring when housing 41 is struck by soccer ball 36 or other projectile. When struck, metal clappers 46 swing to strike outer shields 47 formed from a thin metal to emit a loud sound. While three (3) bells 44 are shown in FIG. 6, one or more bells may be used as desired. Housing 41 is not required to flex as in housing 21 and no switch such as switch 30 is used.

The illustrations and examples provided herein are for explanatory purposes and are not intended to limit the scope of the appended claims.

I claim:

1. An audible target in combination with a goal, said audible target comprising:

a) a semi-rigid housing, said housing comprising a front and a rear target surface;

b) a means for detecting the impact of a projectile upon said housing; and c) a means for producing sound, said goal comprising:

a) a frame, said frame defining a vertical front opening, b) a net, said net affixed to said frame and extending rearwardly of said front opening, and said audible target housing directly attached to said net rearwardly of said front opening.

2. The combination of claim 1 wherein said target front and said rear each define offset lip edges.

3. The combination of claim 1 wherein said goal comprises a soccer goal, and said vertical front opening has an inverted U-shape.

4. The combination of claim 1 wherein said sound producing means is totally contained within said housing.

5. The combination of claim 1 wherein said sound producing means comprises electrical circuitry, an electronic sound producing means, said electronic sound producing means comprising a speaker and a peizo switch, said speaker and said peizo switch connected to said electrical circuitry.

6. The combination of claim 5 wherein said sound producing means further comprises a CPU, said peizo switch connected to said CPU.

7. The combination of claim 1 wherein said target comprises a fastener, said fastener affixed to said housing and to said net, said housing front comprising a first color, said housing rear comprising a second color, said first color different from said second color to allow said target to be reversed on said net to expose said first color or said second color when viewed from said frame front opening.

8. A method of signaling an impact on a target within a goal for a sport comprising the steps of:

a) providing a reversible audible target having a different colored front and back with a programmable CPU, a peizo switch to detect the impact of projectile upon said target and an impact sensitive audible alarm totally contained within a semi-rigid housing;

b) providing a goal with a frame having an inverted U-shaped vertical front opening and a net;

c) attaching the target to the net in spatial relation to the front opening; and d) impacting the target with a projectile to generate the impact sensitive audible alarm.

9. The method of claim 8 wherein providing a goal comprises the step of providing a goal with a frame with a net affixed to a rear of the frame behind the U-shaped front opening.

10. The method of claim 8 wherein attaching the target comprises the step of attaching a target directly to the net inside of the goal.

11. The method of claim 8 wherein providing a target comprises the step of providing a target with a CPU programmable for various modes of operation including an audible count mode, a sound effect mode, an impact limit mode and a timer mode.

12. The method of claim 8 wherein providing a target comprises the step of providing a target with a remotely programmable CPU.

13. The method of claim 8 wherein providing a target comprises the step of providing a target with RF transmission capability.

* * * * *